US005471854A

United States Patent [19]

DeNolf

[11] Patent Number: 5,471,854

[45] Date of Patent: Dec. 5, 1995

[54] ACCUMULATOR FOR AN AIR CONDITIONING SYSTEM

[75] Inventor: Steven J. DeNolf, Anderson, S.C.

[73] Assignee: Automotive Fluid Systems, Inc., Wilmington, Del.

[21] Appl. No.: 260,525

[22] Filed: Jun. 16, 1994

[51] Int. Cl.[6] ..... F25B 43/00

[52] U.S. Cl. ..... 62/474; 62/503; 62/135; 62/139; 62/192

[58] Field of Search ..... 62/503, 512, 474; 96/135, 139, 192, 189, 190, 191

[56] References Cited

U.S. PATENT DOCUMENTS

| | | | |
|---|---|---|---|
| 1,878,694 | 9/1932 | Gay . | |
| 2,729,950 | 1/1956 | Toothman . | |
| 3,563,053 | 2/1971 | Bottum . | |
| 3,721,104 | 3/1973 | Adler . | |
| 3,798,921 | 3/1974 | Scherer et al. . | |
| 4,111,005 | 9/1978 | Livesay . | |
| 4,182,136 | 1/1980 | Morse . | |
| 4,194,370 | 3/1980 | Morse . | |
| 4,208,887 | 6/1980 | Morse et al. . | |
| 4,236,381 | 12/1980 | Imral et al. . | |
| 4,291,548 | 9/1981 | Livesay . | |
| 4,474,034 | 10/1984 | Avery, Jr. . | |
| 4,496,378 | 1/1985 | Kish . | |
| 4,627,247 | 12/1986 | Morse . | |
| 4,653,282 | 3/1987 | Gueneau . | |
| 4,702,089 | 10/1987 | Olson . | |
| 4,757,696 | 7/1988 | Gannaway . | |
| 4,768,355 | 9/1988 | Breuhan et al. . | |
| 4,800,737 | 1/1989 | Smith et al. . | |
| 4,827,725 | 5/1989 | Morse . | |
| 4,938,036 | 7/1990 | Hodgkins et al. | 62/503 |
| 5,052,193 | 10/1991 | Pettitt et al. . | |
| 5,058,395 | 10/1991 | Ni et al. . | |
| 5,184,480 | 2/1993 | Kolpacke . | |
| 5,211,025 | 5/1993 | Ni et al. . | |

*Primary Examiner*—John M. Sollecito
*Attorney, Agent, or Firm*—Remy J. VanOphem; John VanOphem

[57] ABSTRACT

An accumulator for use in an automobile, has an inner housing located within an outer housing. The inner housing has a channel formed therein, such that a fluid-tight flow path which goes down one side across the bottom and back up the other side to an exit orifice is defined. A cap having inlet and outlet orifices therethrough is secured to the outer housing and seals both the inner and the outer housings to prevent any leakage of any fluid.

11 Claims, 2 Drawing Sheets

ACCUMULATOR FOR AN AIR CONDITIONING SYSTEM

BACKGROUND OF THE INVENTION

1. Field of the Invention

The present invention relates to a suction accumulator for use in an air conditioning system, and more particularly to a suction accumulator for use in an air conditioning refrigeration system of a motor vehicle.

2. Description of the Prior Art

The use of accumulators in air conditioning systems, particularly motor vehicle air conditioning systems, is well known. In a typical air conditioning system, the compressor receives a gaseous refrigerant fluid from the evaporator and compresses the gaseous refrigerant fluid, sending it under high pressure to the condenser as a superheated vapor. Since the high pressure vapor delivered to a condenser is much hotter than the surrounding air, the heat of the high pressure vapor is given off to the outside air flowing through the condenser fins thereby cooling the refrigerant fluid. As the gaseous refrigerant fluid loses heat to the surrounding air, it condenses into a liquid refrigerant fluid. The condensed liquid refrigerant fluid then enters an orifice tube at which the pressurized liquid refrigerant fluid transforms into a gaseous state thereby absorbing heat from warm air passing through the fins of the evaporator.

After the warmed liquid refrigerant fluid changes its phase to gas it is passed from the evaporator to an accumulator. From the accumulator, the refrigerant fluid is passed back to the compressor to start the cycle over again. However, it is very important to ensure that the refrigerant gas/fluid mixture being passed back to the compressor is in a completely gaseous state. If liquid refrigerant fluid reaches the compressor it will clog it up, thus, the accumulator's main purpose is to assure that only gaseous refrigerant fluid passes to the compressor. Additionally, the accumulator injects a prescribed amount of lubricating oil into the gaseous refrigerant fluid for lubricating the compressor. Furthermore, the accumulator can be used to make sure the oil-laden gaseous refrigerant fluid is free of particulates that might also harm the compressor.

Accordingly, the accumulator of an air-conditioning system can be used to accomplish five functions, it (a) completely vaporizes the refrigerant fluid, (b) removes all water vapor, (c) traps all particulates, (d) injects a lubricant into the outgoing refrigerant fluid vapor stream, and (e) acts as a reservoir for the refrigerant fluid when system demand is low. Typical examples of accumulators accomplishing these functions are shown in U.S. Pat. Nos. 3,798,921; 4,111,005; 4,291,548; 4,496,378; 5,052,193; and 5,282,370.

Typically, a suction accumulator consists of a liquid storage vessel in which is received a generally U-shaped tube, one end of which is connected to the outlet of the storage vessel and the other end of which is opened to the interior of the vessel. As the incoming liquid refrigerant fluid flows into the vessel, it collects in the bottom of the interior and the gaseous components of the refrigerant fluid are forced, due to pressure in the accumulator and the vacuum created by the compressor, through the open end of the U-shaped tube and out of the accumulator. Oil for lubricating the compressor collects in the bottom of the vessel along with any liquid refrigerant fluid. Typically, an orifice located in the bight portion of the U-shaped tube entrains a metered amount of oil and refrigerant fluid into the fluid exiting the accumulator.

A problem with prior art accumulators is that it is necessary to introduce some type of device, such as a baffle member, to prevent liquid refrigerant fluid from exiting the accumulator or gaining access to the open end of the U-shaped tube. Thus, it is customary to employ a baffle member somewhere proximate the open inlet end of the U-shaped tube in order to prevent the liquid from entering the exit tube of the accumulator. Typically, these baffle members have a frustoconical design which serves to deflect the liquid refrigerant fluid back down into the bottom portion of the accumulator while allowing the gaseous refrigerant fluid to pass by. Examples of such devices include U.S. Pat. No. 5,052,193, to Pettitt et al., U.S. Pat. No. 4,653,282, to Gueneau; and U.S. Pat. No. 4,111,005, to Livesay. Different designs have been proposed in an attempt to achieve the above-stated objectives while trying to increase the efficiency of the accumulator and decrease the costs associated with manufacturing. Examples include U.S. Pat. No. 5,184,480 to Kolpacke, in which the typical U-shaped exit tube is replaced with a molded integral outlet tube positioned to remove the gaseous refrigerant fluid directly through the bottom of the accumulator. However, even in the accumulator of the Kolpacke patent, while there is a baffle it is still necessary to provide a tube for carrying off the gaseous refrigerant fluid from the accumulator.

U.S. Pat. No. 4,236,381, to Imral et al, and U.S. Pat. No. 4,653,282, to Gueneau, each disclose an accumulator for use in a refrigeration circuit. Each disclose that the accumulator is made up of a plurality of vessels, one contained within the other. However, Imral et al. and Gueneau also disclose that an exit tube is inserted within the accumulator for carrying off the gaseous refrigerant fluid from the accumulator. Additionally, both Gueneau and Imral et al. are directed to an accumulator which is capable of achieving a result in addition to and separate from that of being an accumulator. In particular, Gueneau discloses that the hot exhaust gases are circulated through the outer vessel to superheat the refrigerant fluid in the accumulator causing it to more quickly turn from a liquid to a gaseous refrigerant fluid. This involves costly additional structure. Imral et al. disclose that the suction accumulator is combined with the receiver of the refrigerant circuit to carry out both functions in the same device.

Accordingly, the prior art accumulators uniformly disclose and teach the use of a baffle member to prevent liquid refrigerant fluid from reaching an exit tube partially located within the accumulator and used to convey the gaseous refrigerant fluid to the compressor. The components, such as the exit tube and the baffle member, necessary to achieve the stated functions of an accumulator, add significantly to the cost, complexity and potential problems associated with prior art accumulators.

Thus, there is still a need for an accumulator for use in an air conditioning system and particularly for use in an air conditioning system of an automotive vehicle, which is more capable and more reliable in preventing liquid refrigerant fluid from reaching the inlet line of the compressor and further wherein the accumulator does not require the use of a baffle member or an exit tube such as is known in the prior art. The elimination of the baffle member and tubes of the prior art would result in significant cost savings in the manufacture of the accumulator.

SUMMARY OF THE INVENTION

The present invention contemplates an accumulator design for an air conditioning system, wherein the accumulator is efficient in its operation, includes a minimum number of parts, and is less expensive to manufacture as compared to known accumulators. To reduce the number of parts and time needed to produce the accumulator, the invention further contemplates an accumulator housing wherein the baffle structure is eliminated and no tubes are incorporated within the housing.

It is an object of the present invention to provide an accumulator embodying an outer housing, an inner housing disposed inside of the outer housing and defining a flow path between the outer and inner housings and a cap for sealing the outer and inner housings and connecting the accumulator to the air conditioning system. A refrigerant fluid is inlet into the inner housing and is then passed from the inner housing into the region between the outer and inner housings such that the refrigerant fluid follows a flow path down one side of the accumulator across the bottom of the accumulator and then back up the other side of the accumulator and out via a passage through the cap.

Another object of the present invention is to provide an accumulator of the type described above in which the outer and inner housings are cylindrical.

Another object of the present invention is to provide an accumulator of the type described above in which a desiccant containing member can be mounted inside of the inner housing.

It is another object of the present invention to provide an accumulator of the type described above which can be made out of a variety of materials.

It is a further object of the present invention to provide an accumulator of the type described above which can be made out of an extruded aluminum.

It is another object of the present invention to provide an accumulator of the type described above which does not include a baffle member.

It is still a further object of the present invention to provide an accumulator of the type described above which does not incorporate a tube located within the housing of the accumulator.

It is yet another object of the present invention to provide an accumulator of the type described above which costs less to manufacture.

The above objects and other objects, features and advantages of the present invention are readily apparent from the following detailed description of the best mode for carrying out the invention when taken in conjunction with the accompanying drawings.

DETAILED DESCRIPTION OF THE PREFERRED EMBODIMENT

Figures 1, 2:
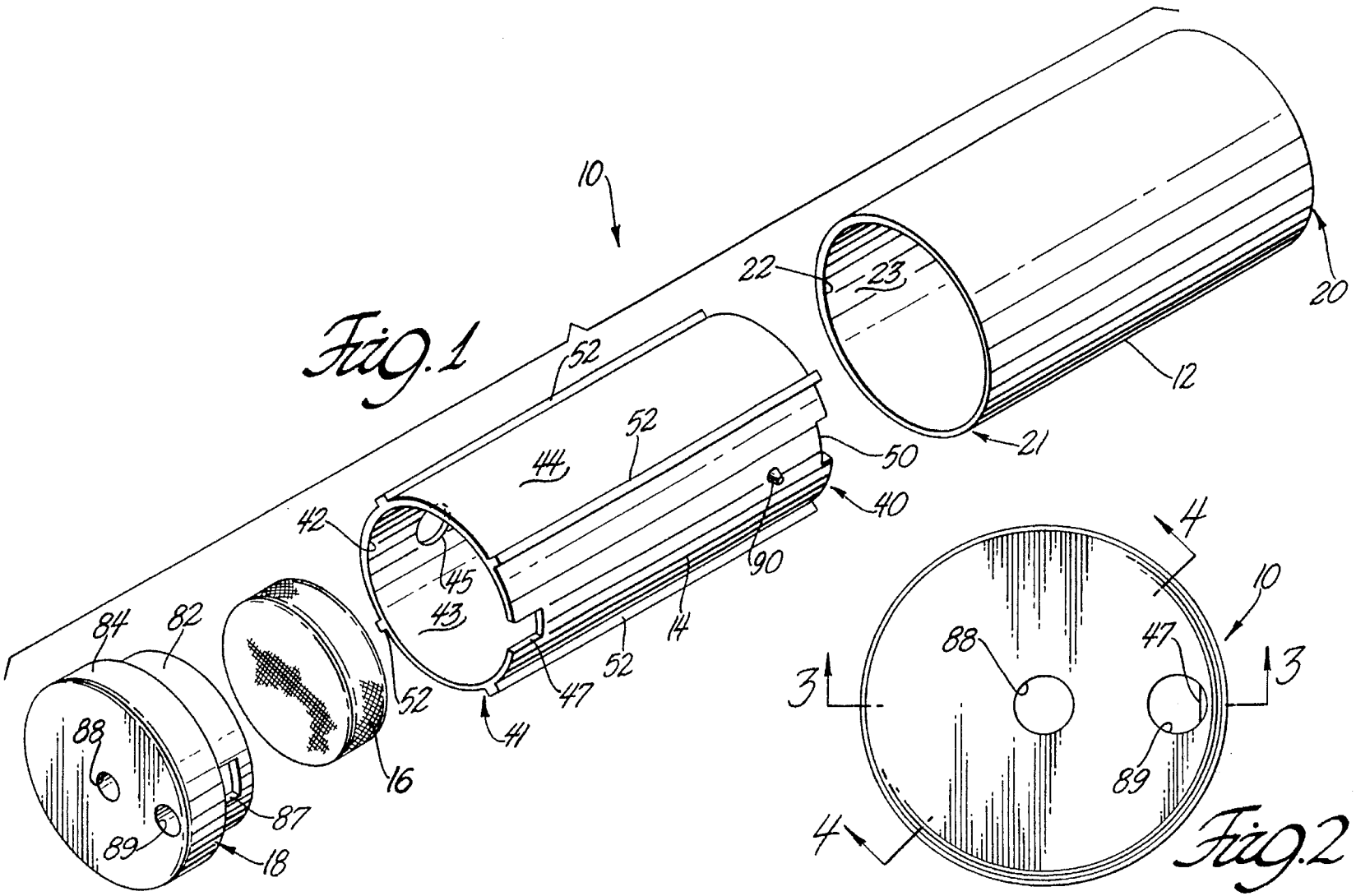
FIG. 1 is an exploded isometric view of an accumulator according to the present invention for use in an air conditioning system.
FIG. 2 is a top view of an accumulator according to the present invention.

With reference to the FIGS. 1 through 6, in general, and particular reference where noted below, an accumulator 10 for use in an automobile's air conditioning system is shown and described herein. The accumulator 10 embodies a first or outer housing 12, a second or inner housing 14, and a cap 18.

As best shown in FIG. 1, the first or outer housing 12 is preferably in the form of a cylinder having a first or lower end 20 and a second or upper end 21. The lower end 20 is closed and may have an essentially flat bottom, while the upper end 21 is open. The outer housing 12 has a side wall 22 having an interior surface 23 which defines an interior volume. Thus, the outer housing 12 is essentially a can having an open top and a closed bottom. Since the side wall 22 is cylindrical in the preferred embodiment the interior surface 23 defines an interior volume having a circular cross section.

It is possible to construct the outer housing 12 out of any material suitable for use as an accumulator in an air conditioning system. However, the housing is preferably manufactured of a lightweight non-corrosive aluminum having sufficient strength to withstand the forces experienced during operation. The outer housing 12 may be constructed using any known method but is preferably extruded or impacted.

The second or inner housing 14 has a first or lower end 40 and a second or upper end 41. Similar to the outer housing 12, the lower end 40 of the inner housing 14 is closed and the upper end 41 is open. The inner housing 14 has a side wall 42, preferably cylindrical, having an interior surface 43 defining an interior volume and an exterior surface 44. Thus, the inner housing 14 is also essentially a can having a closed end and an open end. The inner housing 14 has a passage or channel 50 integrally formed along its lower end 40 and additional structure, which will be described in detail later, for creating a flow path between the housings once the inner housing 14 is inserted in the outer housing 12.

Both the outer housing 12 and the inner housing 14 have a longitudinal center axis. A plurality of longitudinal, radially extending angularly spaced apart tangs 52 are provided along the outer periphery of the side wall 42 of the inner housing 14. The tangs 52, in the preferred embodiment, are integral with the housing 14. The tangs 52 run the entire longitudinal extent of the exterior surface 44 of the side wall 42 and are aligned such that they extend perpendicular from the exterior surface of the side wall 42. Thus, in the preferred embodiment where the side wall 42 is a cylindrical surface, each tang 52 extends perpendicular to a tangent of the exterior surface 44 of the cylindrical side wall 42 of the inner housing 14. In the preferred embodiment, four tangs, each numbered 52, are spaced angularly at predetermined positions about the exterior surface 44 of the side wall 42.

Figure 3:
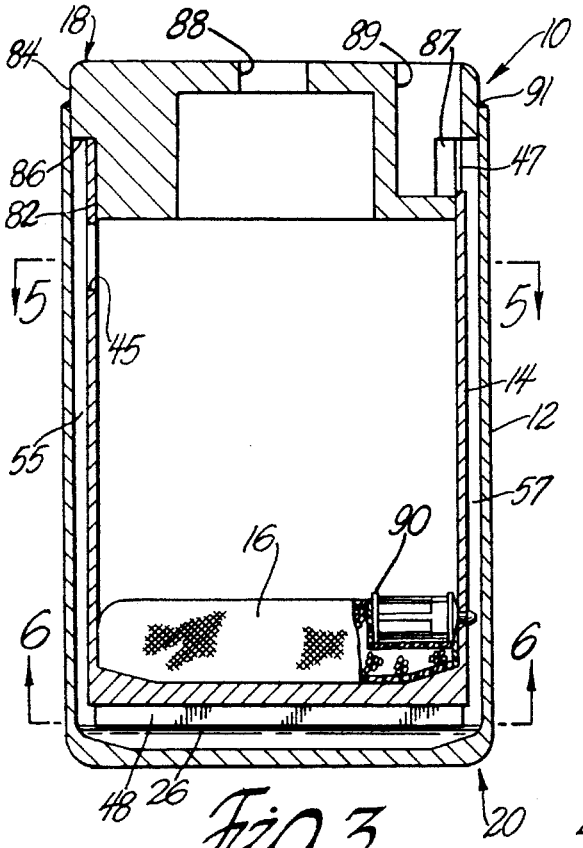
FIG. 3 is a front cross-sectional view in the direction of the arrows taken along the line 3—3 in FIG. 2 of an accumulator according to the present invention.
Figure 4:
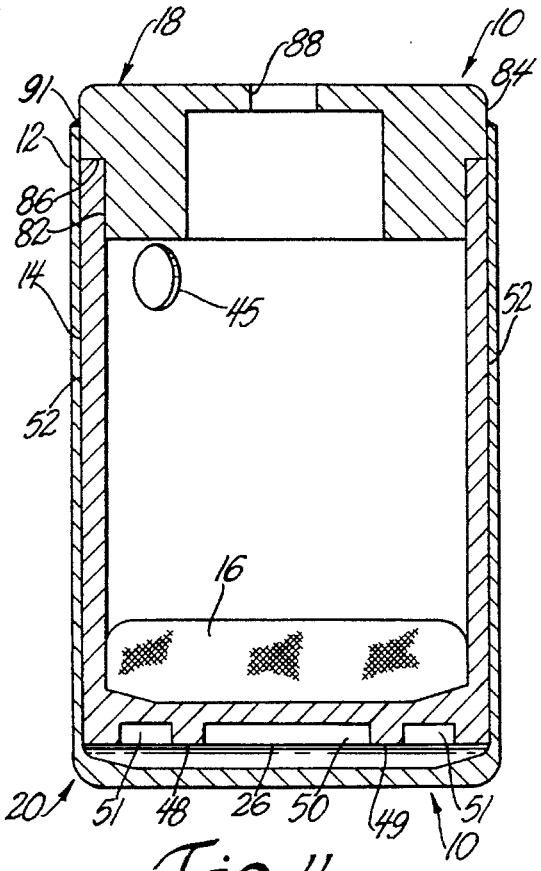
FIG. 4 is a cross-sectional view in the direction of the arrows taken along the line 4—4 in FIG. 2 of an accumulator according to the present invention.
Figure 5:
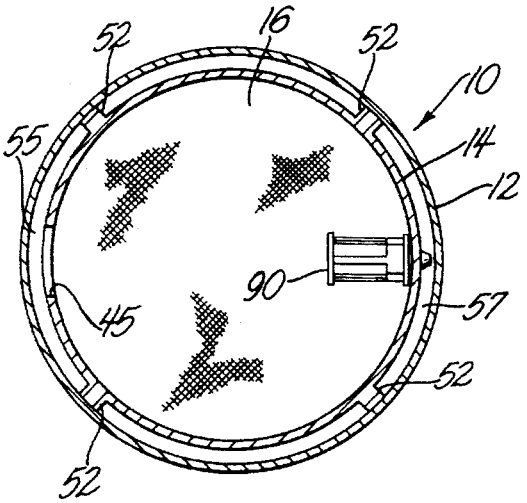
FIG. 5 is a top cross-sectional view in the direction of the arrow taken along the line 5—5 in FIG. 3 of an accumulator according to the present invention.
Figure 6:
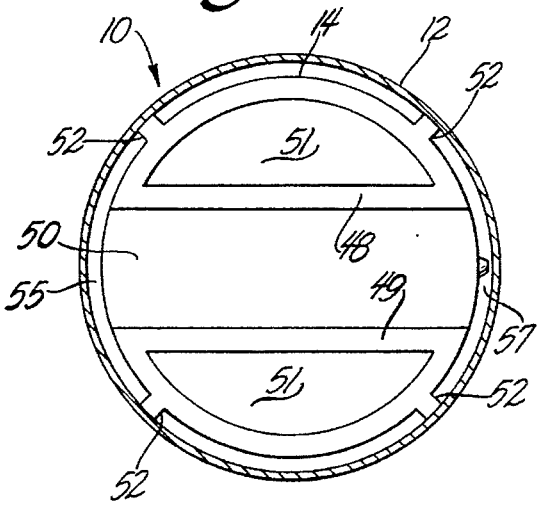
FIG. 6 is a bottom cross-sectional view in the direction of the arrows taken along the line 6—6 in FIG. 3 of an accumulator according to the present invention.

The tangs 52 extend radially from the outer surface of the side wall 42 a predetermined distance. The distance is chosen such that when the inner housing 14 is inserted into the interior volume of the outer housing 12 the tangs 52 form an interference fit with the interior surface 23 of the side wall 22 of the outer housing 12. The interference fit between the tangs 52 of the inner housing 14 and the interior surface 23 of the side wall 22 of the outer housing 12 is such that a substantially fluid tight seal is created therebetween. Thus, the tangs 52 serve to define a pair of chambers between the inner housing 14 and the outer housing 12 once the inner housing 14 is inserted within the outer housing 12 as shown in FIG. 3 and FIG. 6.

Several chambers are defined by the outer periphery of the side wall 42 of the inner housing 14, the interior surface 23 of the side wall 22 of the outer housing 12, and the tangs 52 once the inner housing 14 is inserted in the outer housing 12, which run from the lower end of the accumulator to the upper end of the accumulator. As previously noted, the tangs 52 located between the inner housing 14 and the outer housing 12 and creating a seal therebetween serve to delineate the chambers between the inner housing 14 and the outer housing 12. Preferably, the plurality of tangs 52 are placed radially about the inner housing 14 in order to divide the chambers between the inner housing 14 and the outer housing 12 into a defined flow path including the passage 50 in the lower end 40 of the inner housing 14, to be described in more detail later. It should be noted that it is possible to have the tangs 52 connected to the side wall 22 of the outer housing 12. to be described in more detail later.

Refrigerant fluid enters the inner housing 14 of the accumulator 10 through an inlet 88 in the cap 18. The flow path defined by the tangs 52 consists of a first chamber 55 which receives the refrigerant fluid from the inner housing 14 and conveys the refrigerant to the lower end of the accumulator 10. The chamber 55 is in fluidic communication with the passage 50 in the bottom of the inner housing 14.

The refrigerant fluid is next conveyed from the passage 50 to a second chamber between the inner housing 14 and the outer housing 12 delineated by the tangs 52. The refrigerant fluid is forced up the second chamber 57 through a notch 47 in the side wall 42 of the inner housing 14 and into an opening 87 of an exit passage 89 in the cap 18. The refrigerant fluid is then passed to a refrigerant line (not pictured) connected to the exit passage 89 of the cap 18.

The passage 50 in the lower end 40 of the inner housing 14 can be formed using any known process. The passage 50 is defined by a first wall 48 and a second wall 49. Voids 51 on each side of the walls 48 and 49 are made in the lower end 40 to save on the amount of material used to make the accumulator. The bottoms of the first and second walls 48 and 49, respectively, form an interferences fit and seal with an inside bottom surface 26 of the outer housing 12 so that refrigerant fluid cannot escape from the passage 50.

It is possible to form the passage 50 in an end of the outer housing 12, the bottom of the inner housing 14, as shown herein, or both, as long as the passage 50 functions to convey the refrigerant fluid across the accumulator and between the housings.

In the preferred embodiment, four tangs 52 are used to create the first and second chambers 55 and 57. Accordingly, because the tangs 52 seal the first and second chambers 55 and 57, the additional chambers located between the first and second chambers 55 and 57 are sealed off from the flow path and do not serve any function in the preferred embodiment.

The tangs 52 run the entire longitudinal extent of the inner housing 14 such that when the inner housing 14 is inserted in the outer housing 12 there are no gaps in which refrigerant fluid may leak past the tangs 52. The tangs 52 used to section the chamber between the exterior of the inner housing 14 and the interior of the outer housing 12 are positioned about the periphery of the exterior of the inner housing 14 at predetermined locations. The preferred locations of the tangs 52 are chosen such that the cross-sectional area of the first and second chambers 55 and 57, respectively, defined between the inner housing 14 and the outer housing 12 is each equivalent to the cross-sectional area of a ⅝ inch diameter tube. This permits that the load experienced by an air-conditioning system due to the present accumulator to be equivalent to that of known accumulators which use a ⅝ inch diameter tube. Thus, the design of the present invention can be chosen such that the accumulator of the present invention can be used to replace existing accumulators.

Once the inner housing 14 is inserted in the outer housing 12, a desiccant containing bag member 16, of any known shape and size, is inserted in the interior volume of the inner housing 14. The desiccant containing bag member 16 is provided to help remove any moisture from the refrigerant fluid which may be harmful to the compressor. Additionally, an oil filter regulator 90 is provided in a hole near the bottom 40 of the inner housing 14. As is well known in accumulators, oil in the refrigerant fluid flowing through the air conditioning system will collect in the bottom of the accumulator. In order to provide lubrication of the compressor, a metered amount of oil is allowed to pass through to the compressor. The oil is drawn into the gaseous refrigerant fluid flowing past the opening in the end of the oil filter regulator 90, as the refrigerant fluid exits the accumulator 10.

Once the oil filter regulator 90 and desiccant containing bag member 16 are inserted in the inner housing 14, the cap 18 is placed on the open upper ends 41 and 21 of the inner and outer housings 14 and 12, respectively. In the preferred embodiment, the cap 18 is then secured to the outer housing 12, using a welding process which results in a braze weld 91. The welding process also serves to seal the cap 18 to prevent refrigerant fluid from escaping.

The cap 18 has an inner or reduced diameter portion 82 which fits inside of the side wall 42 of the inner housing 14 and is in interference fit with the interior surface 43. The cap is positioned such that the opening 87 in the exit passage 89 is aligned with the notch 47 of the inner housing 14. The cap 18 has an outer diameter portion 84 which is preferably sized to form an interference fit with the interior surface 23 of the side wall 22 of the outer housing 12.

A surface 86 extends radially and angularly around the cap 18 between the inner and outer diameter portions 82 and 84. The surface 86 serves to cap the first and second chambers 55 and 57 by sealing the ends of the tangs 52.

The accumulator of the present invention allows for any type of tube to be connected thereto at any angle or position. This can be accommodated by using a cap 18 which can be easily changed to have the inlet and outlet holes ported through the cap 18 in order to connect the inlet and outlet tubes at any point thereon, including on the side of the cap. Thus, the same accumulator can easily be used in different automotive vehicles merely by changing one piece, the cap 18.

The gaseous refrigerant fluid collected in the interior volume of the inner housing 14 is forced through a first orifice 45 in the side wall 42 of the inner housing 14 into the first chamber 55. The first orifice 45, in the preferred embodiment, is a hole in the side wall 42 located in the upper region of the inner housing 14. Preferably, the first orifice 45 is positioned such that only vaporized refrigerant fluid is allowed to pass from the inner housing 14 into the first chamber 55 located between the exterior of the inner housing 14 and interior of the outer housing 12 and further delineated by the tangs 52. Once the refrigerant fluid is in the first chamber 55 between the inner housing 14 and the outer housing 12 it is forced to descend down the first chamber 55 to the lower ends 40 and 20 of the inner and outer housings 14 and 12, respectively, into the passage 50 preferably located in the lower end 40 of the inner housing 14.

While the invention has been described in terms of a preferred embodiment, it is apparent that other forms could be adopted by one skilled in the art. The accumulator according to the present invention allows for significant changes in the dimensions of the accumulator such that it is possible to have accumulators of different dimensions, shapes and sizes utilizing the invention described herein. Additionally, it should be obvious that the exterior structure, such as the cap 18 and the outer housing 12, the desiccant containing bag member 16 and the oil filter regulator 90, can be modified by one skilled in the art without departing from the invention as disclosed herein. It would also be possible to reverse the structure of the inner and outer housings to achieve the same flow path as described herein. Accordingly, the scope of the invention is to be limited only by the following claims.

What is claimed is:

1. An accumulator for use in an air conditioning system comprising:

an inner housing having a first end, an integral closed second end and a side wall having a passage therethrough, said first end of said inner housing having a passage formed thereacross;

an outer housing having a first end and an integral closed second end, said inner housing being inserted into said outer housing;

a cap connected to said inner and said outer housings;

means for introducing a fluid into said inner housing; and means for conveying said fluid from said inner housing to said outer housing and from said outer housing to said cap;

whereby a fluid entering said accumulator collects in said inner housing and is conveyed from said inner housing to said outer housing, through said passage, and from said outer housing to said cap where said gas exits said accumulator.

2. The accumulator of claim 1 further comprising:

a plurality of dividers located between said inner housing and said outer housing, said plurality of dividers dividing the area between said inner and said outer housings into a defined flow path.

3. The accumulator of claim 1 further comprising:

a desiccant containing member, said desiccant containing member inserted in said inner housing.

4. The accumulator of claim 1 further comprising:

means for connecting said accumulator to a refrigeration circuit for use within said air conditioning system.

5. An accumulator for use in an air conditioning system comprising:

an outer cylindrical housing having a first end, a closed integral second end and a side wall defining an interior volume;

an inner cylindrical housing having a first end, a closed integral second end, a side wall having an interior surface defining an interior volume and an exterior surface, said inner cylindrical housing being inserted and completely contained within said outer cylindrical housing, said first end of said inner cylindrical housing contacting said first end of said outer cylindrical housing, said inner cylindrical housing having a channel integrally formed in said exterior surface; and a cap connected to said inner and outer housing for sealing said outer cylindrical housing and said inner cylindrical housing.

6. The accumulator of claim 5 further comprising a plurality of dividers located between said inner cylindrical housing and said outer cylindrical housing.

7. The accumulator of claim 5 further comprising:

a desiccant containing member inserted in said inner cylindrical housing.

8. The accumulator of claim 5 wherein said cap has a first passage therethrough for communicating a refrigerant fluid to said interior volume of said inner cylindrical housing, and said cap has a second passage therethrough for removing said refrigerant fluid from between said inner cylindrical housing and said outer cylindrical housing.

9. The accumulator of claim 5 further comprising:

means for connecting said accumulator to an air conditioning system.

10. The accumulator of claim 5 further comprising:

means for lubricating said refrigerant fluid exiting said accumulator.

11. An accumulator for use in an air conditioning system comprising:

an outer housing having an open end, an integral closed end and a side wall;

an inner housing having an open end, an integral closed end and a side wall having a hole therein, said inner housing being inserted in said outer housing such that said closed end of said inner housing is aligned with said closed end of said outer housing;

a cap connected to said open ends of said inner and said outer housings, said cap having an inlet hole therein for conveying a refrigerant fluid into said inner housing;

a flow path located between said inner housing and said outer housing, said flow path in fluidic communication with said hole in said side wall of said inner housing; and means for removing said refrigerant fluid from said flow path and said accumulator.

* * * * *

UNITED STATES PATENT AND TRADEMARK OFFICE

CERTIFICATE OF CORRECTION

PATENT NO. : 5,471,854

DATED : Dec. 5, 1995

INVENTOR(S) : Steven J. DeNolf

It is certified that error appears in the above-indentified patent and that said Letters Patent is hereby corrected as shown below:

Column 5, line 31, after "chamber" insert ---- 57 ----.

Column 5, line 44, delete "interferences" insert —interference—

Column 6, line 4, delete ---- that ----.

Column 7, line 40, delete "gas" insert ---- fluid ----.

Signed and Sealed this

Twenty-sixth Day of March, 1996

Bruce Lehman

*Attest:*

BRUCE LEHMAN

*Attesting Officer*

*Commissioner of Patents and Trademarks*